US005966069A

United States Patent [19]

Zmurk et al.

[11] Patent Number: 5,966,069

[45] Date of Patent: Oct. 12, 1999

[54] EXIT SIGN SELF-TESTING SYSTEM

[75] Inventors: Greg Zmurk; Steve Buckser, both of San Leandro, Calif.

[73] Assignee: Prescolite-Moldcast Lighting Company, San Leandro, Calif.

[21] Appl. No.: 09/045,628

[22] Filed: Mar. 19, 1998

[51] Int. Cl.[6] ..... G08B 3/00

[52] U.S. Cl. ..... 340/330; 340/333; 340/506; 340/507; 340/514; 340/516; 340/636; 307/64; 362/20; 315/86

[58] Field of Search ..... 340/330, 506, 340/507, 514, 516, 636, 333; 307/64, 66; 362/20; 315/86

[56] References Cited

U.S. PATENT DOCUMENTS

| | | | |
|---|---|---|---|
| 3,384,886 | 5/1968 | Serra | 340/333 |
| 4,088,986 | 5/1978 | Boucher | 340/333 |
| 4,199,754 | 4/1980 | Johnson et al. | 340/577 |
| 4,441,066 | 4/1984 | Burmenko | 340/636 |
| 4,544,910 | 10/1985 | Hoberman | 340/333 |
| 4,799,039 | 1/1989 | Balcom et al. | 340/333 |
| 4,965,548 | 10/1990 | Fayfield | 340/511 |
| 5,621,394 | 4/1997 | Barrick et al. | 340/628 |

*Primary Examiner*—Jeffery A. Hofsass
*Assistant Examiner*—Julie B. Lieu
*Attorney, Agent, or Firm*—Theodore J. Bielen, Jr.

[57] ABSTRACT

A system for testing the electrical integrity of an illuminated exit sign alternately powered by a battery, rechargeable from a source of alternating current power. The system includes an alarm for indicating an electrical failure, precluding the illumination of the exit sign. A circuit tests the presence of battery electrical power for illuminating the exit sign. In addition, the circuitry periodically tests for the provision of adequate battery power to achieve the same function. Moreover, the system periodically tests and retests for adequate recharging of the battery during a preselected period of time and includes an alarm for indicating failure of the recharging system.

6 Claims, 4 Drawing Sheets

EXIT SIGN SELF-TESTING SYSTEM

BACKGROUND OF THE INVENTION

The present invention relates to a novel and useful system for testing the electrical integrity of an illuminated exit sign.

Illuminated exit signs are required by law to be placed in edifices to indicate egress from a structure as a matter of convenience and during periods of emergency. It is, thus, important that such exit signs be reliable, being provided with a constant supply of electrical power to maintain illumination of the exit signs at all times. Along these lines, it is imperative that the integrity of the electrical system of an illuminated exit sign be tested at selected intervals to ensure that power is always available to the exit sign under all conditions. That is to say, the existence of a battery, the integrity of the battery, the charging system for the battery, and the like, must constantly be determined.

In the past, many testing procedures for illuminated exit signs have been accomplished manually by roving personnel. Written records must also be kept of such visual inspections and tests for review by legal entities having jurisdiction over such matters. Recently, many rules and regulations have permitted the use of self-testing and self-diagnostic illuminated exit signs operated by a battery, in conjunction with limited visual inspections by personnel. Thus, it is advantageous to provide illuminated exit signs that are capable of accomplishing such self-tests.

U.S. Pat. Nos. 3,384,886, 4,088,986, and 4,544,910 describe emergency lighting and exit sign systems that include indicators showing the existence of stand-by power, the proper level of voltage of the stand by power and the integrity of a battery.

U.S. Pat. No. 4,199,754 shows a circuit for an emergency lighting and fire detection system which latches an emergency light in an off position indicating that a low voltage condition exists in the battery power source.

An exit sign which is capable of continually self testing and retesting source of battery power and recharging system for such battery would be a notable advance in the emergency lighting field.

SUMMARY OF THE INVENTION

In accordance with the present invention a novel and useful system for the testing of the electrical integrity of an illuminated exit sign is herein provided.

The system of the present invention utilizes an exit sign that is alternately powered by a battery or a source of alternating current, which also is capable of recharging the battery. The exit sign includes alarm means for indicating an electrical failure which would preclude the illumination of the exit sign. Such alarm means may be a bi-color indicator which is capable of emitting a steady light or a blinking light, as the case requires.

Circuit means is included in the exit sign for periodically testing the presence of a battery at certain time intervals. In other words, the absence of battery power is determined during intervals. In addition, means is provided for periodically testing the level of battery power which is adequate to illuminate the exit sign. The alarm means indicates either situation.

Further, the existence of source of lighting, such as an LED light strip is also determined by the circuitry of the present invention. Again, the alarm means would indicate by a certain color of light or a particular pattern of light the existence or non existence of the LED strip. In one embodiment of the invention, signal voltage of a peculiar pattern is detected by comparator which is indicative of the presence of the LED strip. If such peculiarly patterned signal disappears, the alarm means would indicate the absence of an LED strip.

Besides the existence and failure of the battery source for the exit sign, the system of the present invention periodically tests the charging system for the battery. That is to say, although a battery may pass its end-of-life test, a subsequent test within a short period of time after charging the battery may indicate a failure. Usually this is interpreted as a charging system failure.

During most of the self-testing activities of the system of the present invention a transfer function takes place in which illumination of the exit sign occurs as a result of exchanging the alternating current source for the battery source. The system of the present invention also checks the integrity of such transfer system, which is the basis of many of the tests herein above described. In other words, the presence of the battery, power level of the battery, and recharging of the battery of the exit sign will require the functioning of the transfer system between the AC and DC power sources.

It may be apparent that a novel and useful system for the testing of the electrical integrity of an illuminated exit sign is herein provided.

It is therefore an object of the present invention to provide a system for testing the electrical integrity of an illuminated exit sign which is capable of testing for the existence of a battery source of power, an adequate level of battery voltage, and recharging system for the battery.

A further object of the present invention is to provide for a system for testing the electrical integrity of an illuminated exit sign which is capable of retesting the battery charging system and a battery end-of-life function after a specific interval following the initial tests of these functions to eliminate false signals.

A further object of the present invention is to provide a system where the testing of the electrical integrity of an illuminated exit sign eliminates many manual tests and reduces the cost of maintaining exit signs in buildings.

Yet another object of the present invention is to provide a system for the testing of the electrical integrity of an illuminated exit sign which includes an alarm indicator having multiple visual cues which are easily interpreted by the user.

A further object of the present invention is to provide a system for the testing of the electrical integrity of an illuminated exit sign which is highly reliable in an emergency situation.

The invention possesses other objects and advantages especially as concerns particular characteristics and features thereof which will become apparent as the specification continues.

For a better understanding of the invention references made to the following detailed description of the preferred embodiments thereof which should be taken in conjunction with the prior described drawings.

DETAILED DESCRIPTION OF THE PREFERRED EMBODIMENTS

Various aspects of the present invention will evolve from the following detailed description of the preferred embodiments which should be referenced to the hereinbefore described drawings.

Figure 1:
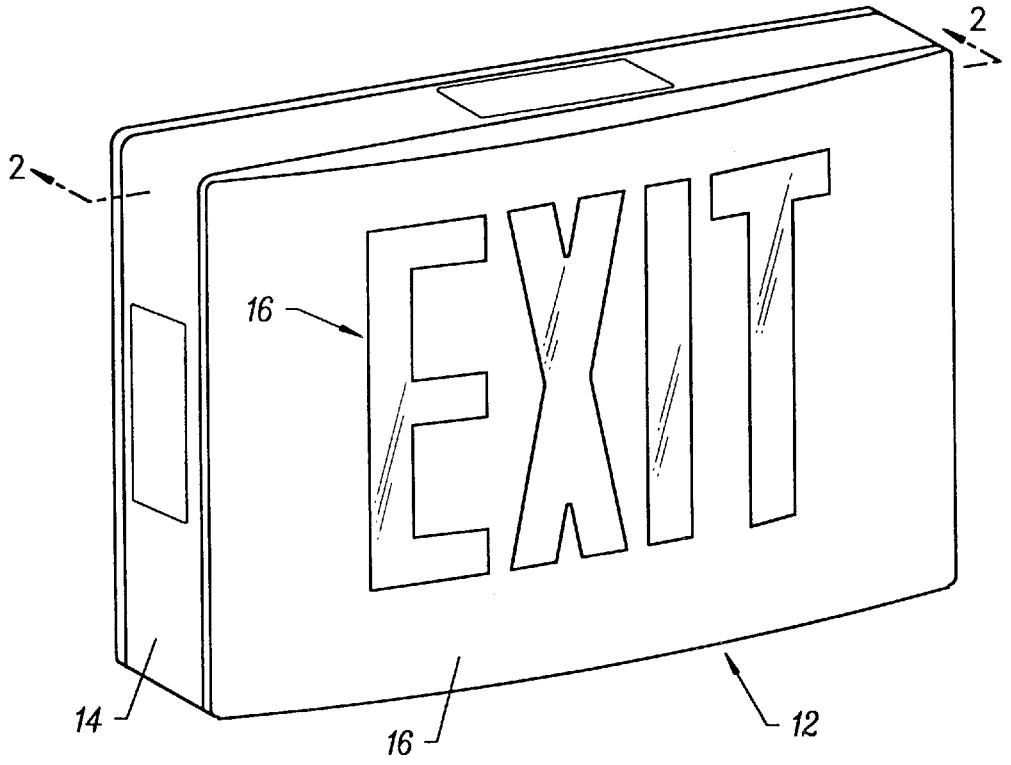
FIG. 1 is a perspective view of the self contained exit sign utilizing the system of the present invention.
Figure 2:
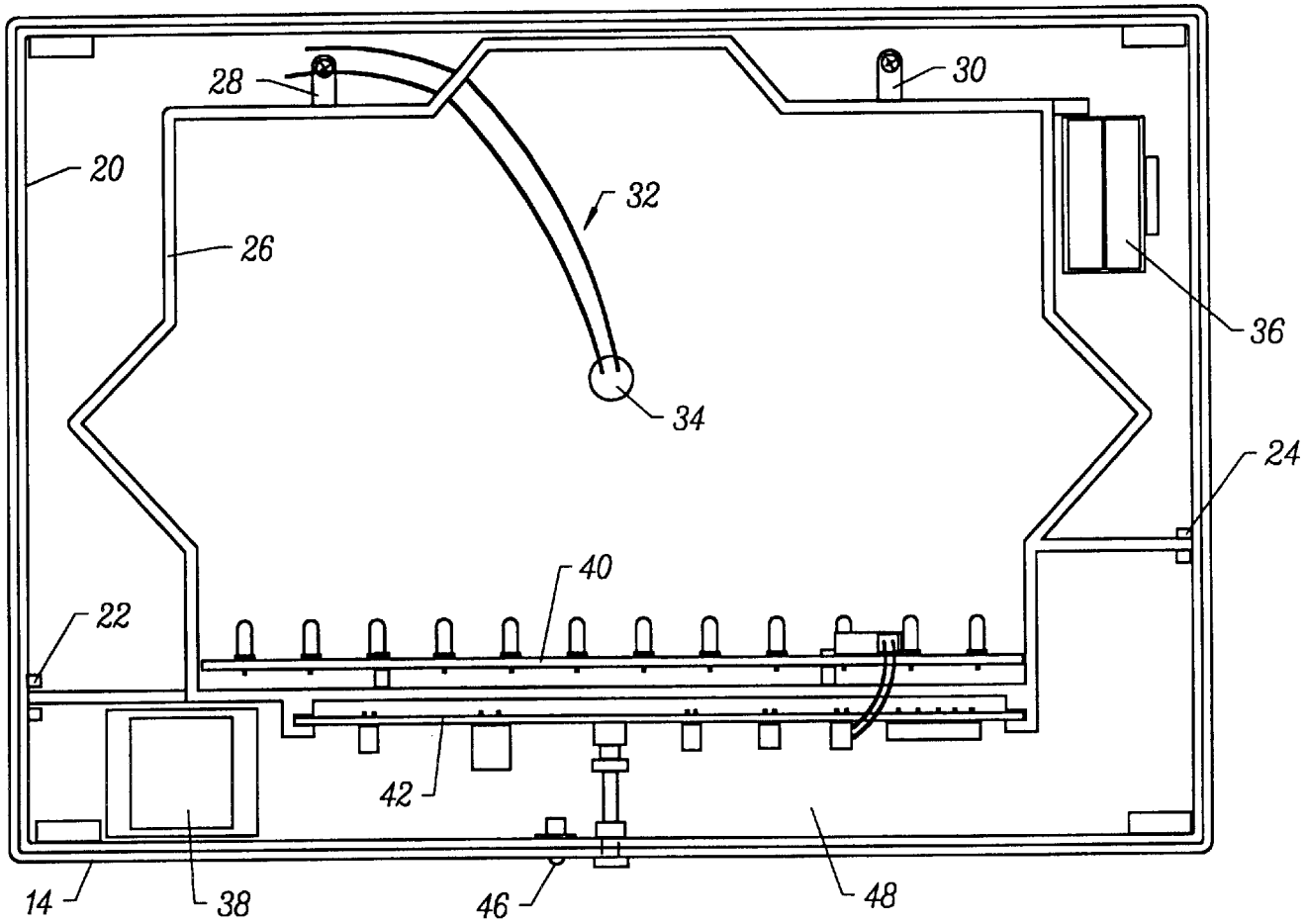
FIG. 2 is a sectional view taken along line 2—2 of FIG. 1.
Figure 3:
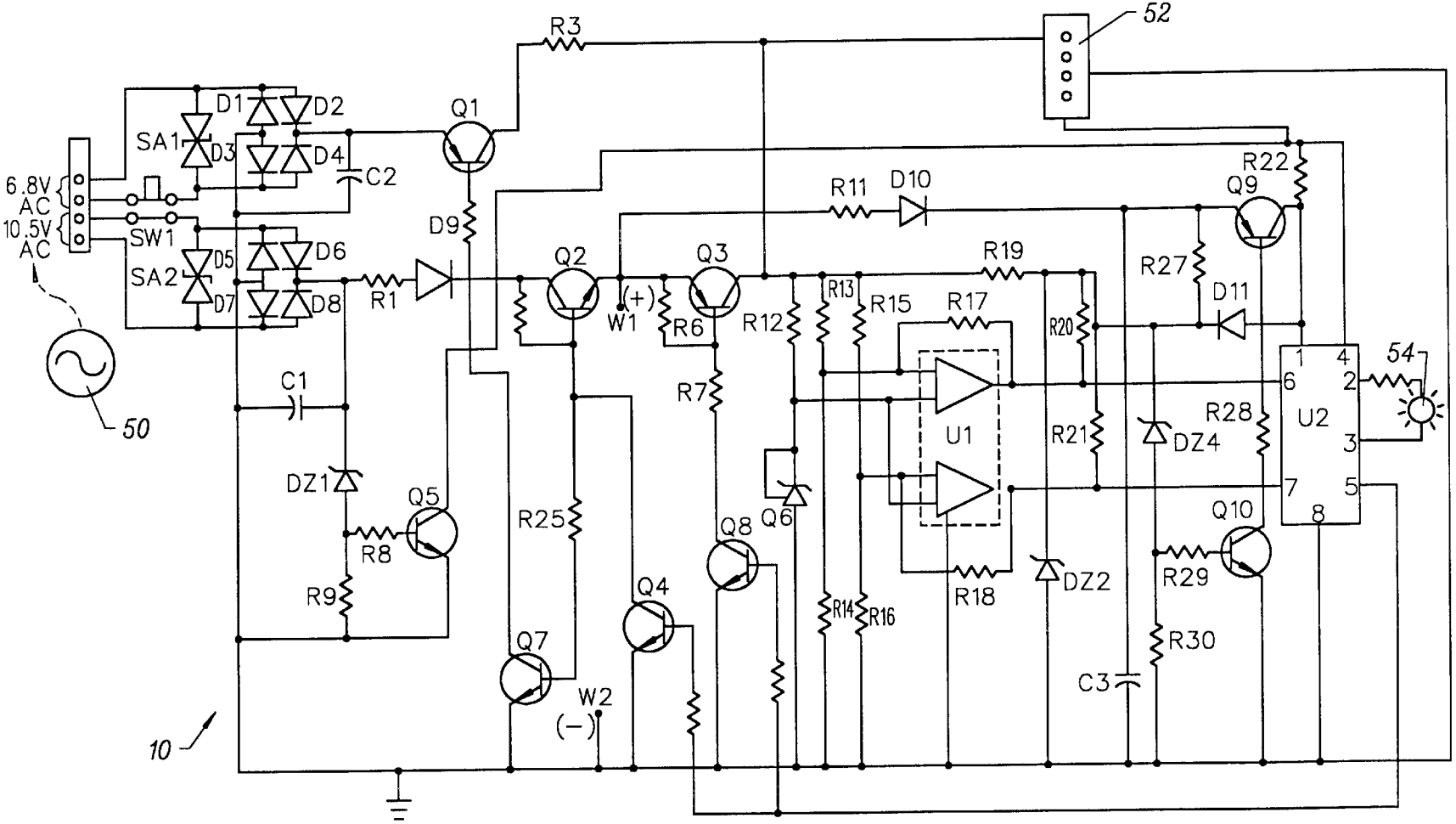
FIG. 3 is an electrical schematic depicting the electrical components of the system of the present invention.

The invention as a whole is depicted in the drawings by reference character 10. The testing system 10, FIG. 3, is used in conjunction with a self contained exit sign unit 12, FIG. 1. Typically, the exit sign unit 12 includes a housing 14 of rigid or semirigid material such as metal, and an illuminated translucent face plate 16 with the indicia "exit" clearly discernable thereupon. With reference to FIG. 2, it may be seen that housing 16 includes an internal wall 20 providing slots 22 and 24 for insert 26. Tabs 28 and 30 fasten to housing 14 to hold insert 26 in place. Electrical conductors 32 feed into housing 14 through opening 34 and are shown partially in FIG. 2. Insert 26 serves as a platform for battery 36, transformer 38, and LED strip 40. System 10 includes electrical components which are found on circuit board 42, located adjacent LED strip 40. Alarm means 44 may also be in the form of a lamp or LED which is visible at the exterior of housing 14 of exit sign unit 12. The electrical interaction between components found within chamber 48 of housing 14 of exit sign unit will be described in greater detail hereinafter.

Turning to FIG. 3, it may be observed that an electrical schematic is depicted showing the working components of system 10. Battery W1, W2, is connected to the terminals prior to inputting of AC power source 50. Upon the connecting of battery W1, W2, transistors Q3 and Q9 remain off. This prevents current from flowing to exit LED light source 52 or to micro controller U2. The AC power input 50 represents a dual-secondary transformer which has both a 6.8 volt AC output and a 10.5 volt AC output. The 6.8 volt AC output is used to drive the LED source 52. The 10.5 volt AC output is used for driving the control circuit pictured in FIG. 3, and for charging the battery W1, W2. During the normal operation of the system 10, AC source 50 is on. The exit LED current flows to surge absorbers SA1 and SA2 and then to the D1–D4 diode bridge. From the D1–D4 diode bridge, the current flows through transistor Q1, resistor R3, and through the LED board 52 to the LED strip 40. At the same time, battery charge current flows from the D5–D8 diode bridge through R1, D9, Q2, and onto the battery W1, W2. At that point there is another path for current to flow through R11, D10, Q9 and to the U2 microcontroller supply pin 1. Should AC power source 50 fail or fall below a fixed voltage, zener diode Z1 will cut-off current to the base of transistor Q5. This, in turn, will cause a signal change at microcontroller U2 input pin 4. The logic within U2 will then initiate a positive voltage at pin 5, which will turn Q8 and Q3 on. This effectively connects battery W1, W2 to the exit LED load 52. It should be noted that the object code programmed into microcontroller U2 is incorporated into the present application as Appendix 1. The connection of the battery to the exit LED condition will continue until there is a change at U2 pin 4. Such change occurs when AC power source 50 is restored and Q8 and Q3 are turned back off. Also, such change will occur if the battery voltage W1, W2 falls below a threshold value determined by D11 and DZ4. It should be noted that the system is shut down by turning off Q10 and Q9 at this point.

Again referring to FIG. 3, the test switch SW1 a double pole, single throw switch, is pressed, the system will react just as if a loss of AC power 50 has occurred. If there are no significant power outages i.e. for a period of more than 10 minutes, the logic and timers within U2 will initiate battery tests as follows:

1. Battery existence test

At 15 second intervals, a 50 microsecond pulse will be placed on U2 pin 5 causing transistors Q1 and Q2 to turn off and transistor Q3 to turn on. This will temporarily connect battery W1, W2 to the exit LED load 52. If the battery is not connected, capacitor C3 will sustain supply voltage to U2 during the test. Voltage at the collector of transistor Q3 will be fed to comparator U1 whose input will either be high or low depending on the existence of the battery W1, W2. This voltage appears at the input to U2 and will be interpreted as a condition by the internal logic of U2. U2 will then drive the status LED 54. It should be noted that status LED 54 may be multicolored i.e. having a green and red condition.

2. Battery failure tests

At the appropriate interval (either 48 hours, 30 days, or 180 days), U2 will drive pin 5 positive, again turning Q1 and Q2 off and Q3 on. The battery W1, W2 is thus connected to the exit load 52 for either 5 or 90 minutes, depending on which type of tests is called for. During this time the battery voltage of battery W1, W2 is continuously monitored by U1 and the result is fed to microcontroller U2. At the end of the test, or if the battery voltage of battery W1, W2 falls below a threshold value, U2 will drive the status LED 54 according to the result. The following table represents the status LED 54 summary.

TABLE 1

STATUS LED 54 OPERATION SUMMARY

| Condition | Appearance of led |
|---|---|
| Normal | Steady green |
| AC power failure | Off |
| Light existence test failure | One red blink followed by a longer off period |
| Transfer system test failure | Two red blinks followed by a longer off period |
| Charging system test failure | Two red blinks followed by a longer off period |
| Battery existence test failure | Three red blinks followed by a longer off period |
| Battery catastrophic test failure | Three red blinks followed by a longer off period |
| Battery end-of-life test failure | Three red blinks followed by a longer off period |

The following table lists typical components employed in the circuitry depicted in FIG. 3.

TABLE 2

TABLE OF COMPONENTS

| Item | Model or Part |
|---|---|
| SW1 | TL2201 |
| D1–D11 | 1N4003 |
| R1, R5 | 100Ω, 1W |
| R3 | 10Ω, 1/2W |
| R23 | 100Ω, 1/4W |
| R4, R6, R27 | 100KΩ |
| R-7, R19, R24 | 330Ω |
| R-8, R20, R21, R22, R25, R26, R29 | 10KΩ |
| R-9, R10, R12, R28, R30 | 1KΩ |
| R11 | 20Ω |

TABLE 2-continued

TABLE OF COMPONENTS

| Item | Model or Part |
|---|---|
| R13 | 90.9KΩ, 1% |
| R14 | 100KΩ, 1% |
| R15 | 61.9KΩ, 1% |
| R16 | 100KΩ, 1% |
| R17, R18 | 1MΩ |
| C1 | 100 μF, 50V |
| C2 | 330 μF, 16V |
| C3 | 10 μF, 50V |
| DZ1 | 1N5237, 8.2V |
| DZ2, DZ4 | 1N5226, 3.3V |
| Q1, Q3, Q9 | MPSA56 |
| Q2, Q4, Q5, Q7, Q8, Q10 | MPSA06 |
| Q6 | TL431 |
| SA1, SA2 | 18V |
| U1 | LM393 |
| U2 | PIC 12C509 |
| W1, W2, Batt | 4.8V DC |

Figure 4:
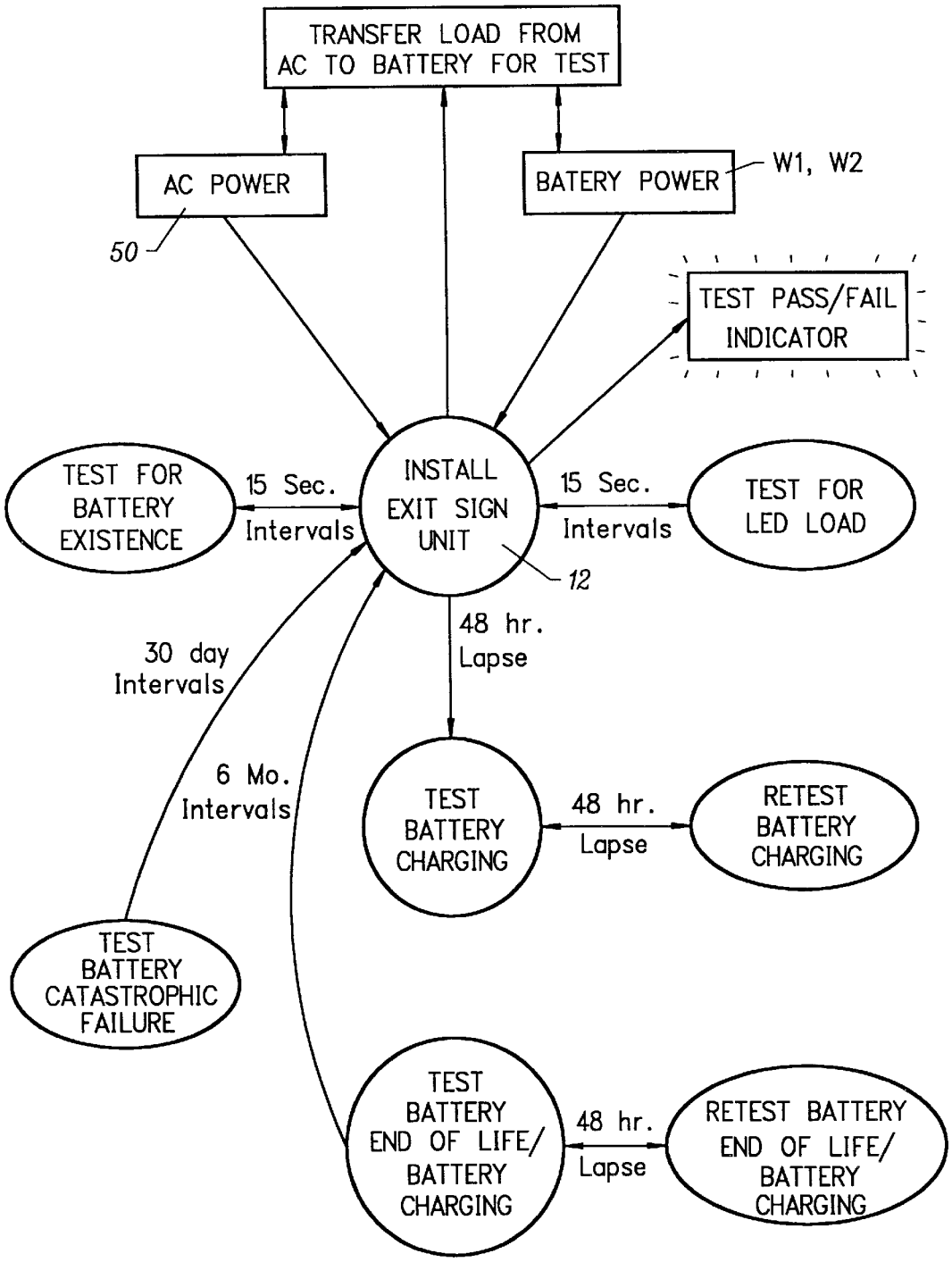
FIG. 4 is a schematic block diagram showing the functional presentation of the system of the present invention.

Turning to FIG. 4, it may be observed that a functional diagram is depicted in which system 10 periodically tests battery W1, W2 for the existence of light strip 40, and transfer and charging circuits for integrity. Status LED 54, a bi-color indicator LED, may indicate either solid green indicating that the system is working properly, or a blinking red pattern which indicates a system failure. Of course, other visual signals may be employed to project the same information to the user.

System 10 tests for the existence of LED strip 52 in that every 15 seconds the control circuit shown in FIG. 3 will check for the existence of an LED load. This is done by checking for a ripple on the rectifier and filter portion of the circuit, specifically at capacitor C2. If the LED strip 40 is disconnected, the exit sign unit 12 status LED 54 will change from green to a repetitive 1 red blink pattern. Such test operates since a signal voltage is checked at LED strip terminal 40 with respect to ground. The control circuit of FIG. 3, expects to see a voltage with some ripple characteristic due to loading effects of the LED light strip 52. The ripple is detected by using comparator 51, with its threshold set between maximum and minimum voltages of the ripple. Thus, during normal operation comparator U1 will exhibit a constant change at its output. The frequency of the change is normally the line input frequency of AC source 50, i.e. 60 Hertz. As long as the control circuit detects the above changes, it will assume that the system is operating normally. If the LED strip 40 is disconnected, the ripple will disappear because the supply circuit is no longer loaded down. In this case, the comparator U1 will not change but will remain constant. Such lack of a signal change will be displayed as an error code above noted in Table 1.

System 10 also tests the transfer system which transfers the load from AC to the battery W1, W2 for testing purposes. Such transfer system consists of the transistors shown in FIG. 3 rather than relays used in the prior art. During a monthly battery test, the transfer system will be checked by the control circuit for the non-existence of a ripple voltage across the load. This is the opposite of the above identified light strip 40 existence test. If the transfer system fails, the indicator LED will change according to that shown in Table 1, i.e. two red blinks. Also, at initial AC power up the AC detection signal will be checked for proper operation. Improper operation of the AC signal will result in a two red blink pattern also.

The charging system is also specifically tested at an arbitrary period set at six months, as well as 48 hours after initial AC power-up. Each test is performed twice for 90 minutes with a 48 hour charging period in between. A "pass" then "fail" sequence is interpreted as a charging system failure. If the failure of the charging system is detected, the unit's indicator LED will again exhibit a two red blink pattern. Charging system failures may also be detected as a battery failure.

Further, system 10 also tests for the battery existence. Every 15 seconds, the control circuit of FIG. 3 will send out a short pulse of 50 micro seconds, transfer the LED light source load from AC to the battery W1, W2 and then back again. If the battery is either not in place, or has an open connection, the unit indicator LED will change from green to a repetitive three blink pattern. It should be noted that the 50 micro second pulse sent by the control circuit of FIG. 3 is short enough and infrequent enough that no significant current is drawn from battery W1, W2. Also, if battery W1, W2 is not present or is in a severely discharged state, a capacitor is connected to the control circuit to prevent a reset caused by a power interruption.

In addition, the battery catastrophic failure test is performed every 30 days. This test begins with the LED light source load being transferred from AC source 50 to battery W1, W2 for five minutes with the battery voltage being monitored. If the voltage of the battery dips below the reference value (e.i. 87.5% nominal) before the load is transferred back to AC, the unit 10 indicator LED 54 will change from green to a repetitive three red blink pattern. The control circuit 10, specifically at micro controller U2, possesses built in timers to count until such test should be performed, in this case. Bipolar transistors simultaneously cut off the LED strip current supplied by the incoming AC power source 50, cut off the battery charging current supply by the incoming AC power source 50, and switch the LED light strip current applied by the battery to an "on" state. After the LED light strip load has been switched to the battery W1, W2, a five minute timer is started by micro controller U2. The LED light strip 52 terminal voltage is monitored by comparator U1 with its threshold set for a voltage determined to provide the minimum light output.

The battery end-of-life failure test is performed every six months, again, by transferring the LED light source load from AC source 50 to battery W1, W2 for a full 90 minutes monitoring the battery voltage. If the battery voltage dips below the reference value the LED status indicator 54 will change from green to a repetitive three red blink pattern. This test may also be programmed to be performed 48 hours after initial AC power up.

System 10 also includes automatic failure retest features in which the initial monthly test failures for the battery integrity, transfer system and the like will cause an automatic retest after two days time has elapsed without a significant power outage. Failure is reported if the first test is failed. However, if the second retest is passed the failure indication will be cleared. This may be attributed to a false signal which is typical of nickel cadmium batteries. Continuous battery monitoring will detect battery replacement if a battery fault condition exists. Battery replacement will automatically clear the battery fault indication and will automatically cause a battery end-of-life failure test after battery W1, W2 has charged for two days time without a significant power outage.

While in the foregoing, embodiments of the present invention have been set forth in considerable detail for the purposes of making a complete disclosure of the invention, it may be apparent to those of skill in the art that numerous changes may made in such detail without departing from the spirit and principles of the invention.

APPENDIX I

```
:10000000FB0A0F0C29000008000C29000A0C0F0A3B
:10001000410C2900040C0F0A410C2900040C2A0091
:100020000008010C180A050C180A0F0C180A230CFA
:100030003B00A8040008010C2B00010C2C00520C02
:100040002D00C805E8042C0A010C2B00480C2C00DC
:10005000010C2D00E805C80488040008CB0C300012
:10006000020C310008040008410C3000010C310082
:1000700008040008C706400AE706400A46040108CB
:1000800046050008A60586040B0C06000008860538
:10009000A6040008A60486040008FC0C7C010008E5
:1000A00029004D0909023C0100081C02030E290029
:1000B0000008170CA4053A00A4040008270 64D09FF
:1000C000CE06660AEE06660A4D097D0A5509090242
:1000D000030EE2016E0A710A750A790A4704010CDF
:1000E0007C0A47077D0A020C7C0A47067D0A030C3E
:1000F0007C0A470667057D0A5009A807FA0A1A0212
:100100000F0EE201920A950A980A9C0AA20AA60A10
:10011000AC0AB00AB60ABA0AC00AC40AC80A920AE5
:10012000920A920A4A091109CC0A42091109CC0A19
:1001300047091309030CF90A4A0915096F06C60A8B
:10014000040CF90A47091309050CF90A4A091509AB
:100150008F06C60A060CF90A47091309070CF90AA3
:100160004A091509AF06C60A080CF90A4709130916
:10017000090CF90A4A091509CF06C60A0A0CF90A38
:10018000470913090B0CF90A4A0915090C0CF90A5D
:100190004A091709000CF90A6F000E06E20A2E063A
:1001A000E20A4E06E60A6E06EA0A8E06EA0A7C06AD
:1001B000EA0AAE06EE0ACE06EE0AEE06EE0A6F0078
:1001C000010CF90A6F000F05000CF90A6F006F05AA
:1001D000020CF90A6F008F0S020CF90A6F00AF05D7
:1001E000020CF90A6F0QCF0S020CF90A6F00EF0547
:1001F000020C3A00220B25006400000C26000B0CB8
:100200000600470C0200E306080B670068007C004C
:100210006E000E056F007A007D007E0059096607AA
:10022000190B04096607190BE902120BEA02120BFB
:100230007C0561007F0013090805E306220BA30576
:100240001709A30401029F012900BF01E907220B3E
:10025000FB022B0BA805F002300BF102300B080556
:10026000F202370BF302370BF402370B680548062E
:10027000420BF502420BF602420BF702420BF80268
:10028000420B4805E806460BC8074D0BEB024D0B29
:10029000EC024D0BED024D0B88050706690B470775
:1002A000690B7C06690B6607690B0C096607690B0D
:1002B000E902560BEA02560BC7053A090109E902A1
:1002C0005F0B0606670BC7043A094704690B07056D
:1002D0002E0507066D0B7C077C0B66067C0B080958
:1002E00066067C0BE902700BEA02700BC7043A0940
:1002F00007042E047C0434094706830B8704A705F2
:10030000C804E804A00B0706940B2706940BE80426
:100310008706A00BC8068E0B1B09A00B8807A00B35
:100320008705A704C804A00BC804A706A00BE8060D
:100330009B0B2409A00B8807A00B8704A705E804E2
:100340000706B60B2706B60B0807B70B2805E70507
:100350003A090109E902AA0B0606B10BAE054704EA
:10036000B30BAE044705E7043A090E042E0928072B
:10037000D20B2804000C29000A0C2A002607D00BF7
:10038000E902BE0BEA02BE0B4E06D20BA405FA022E
:10039000CD0BA4044E055909D20BA4042805D20B99
:1003A0004E0459090707E20B0606E20BA405F90003
:1003B000A4044307E60BC704E7043A094A092602E6
:1003C0000300E60B020CA4053900A404A305550A9A
:10040000E60C3200240C3300010C0B0A000C320005
:10041000880C3300030C3400680400083900000C19
:1004200035003600370004 0C380048040008010C81
:1004300039004805A3041B09A3058704A705000884
:10044000000C29000A0C2A0026072C0AE902240ABB
:10045000EA02240A690000086900A90201082706C7
:10046000400A48073D0A07063D0A87073D0A470735
:100470003D0A4E063D0A69000008010C29000108EA
:10048000020C290002082705290009064 90A00096B
:100490004A0A0609E705A3043A09A3050008E70488
:1004A000A3043A09A305270400081D020F0EE20168
:1004B000680A6B0A730A760A7F0A850A880A900A14
:1004C000930A9C0A680A680A680A680A680A680A3D
:1004D0002706A10AB40A27079F0A20090906720AFB
```

-continued

APPENDIX I

```
:1004E0006E04A30AA50A27079F0AB40A2707B40ABD
:1004F000200909067D0A6E04A30A6E05A70A2706CD
:10050000B40A4806A90A1909A90A2707B40AAB0AB6
:100510002707A90A200909068F0A6E04AD0AAF0A47
:1005200027079F0AB40A2707A90A200909069A0A79
:100530006E04AD0A6E05B10A2707A90AB40A000CB9
:10054000B30A010CB30A020CB30A030CB30A040C7D
:10055000B30A050CB30A060CB30A070CB30A080C5D
:10056000B30A090CB30A3D006707BB0ACE04EE04C8
:100570001709670453 0B1E020F0EE201CE0ADF0AB1
:10058000EE0AF90A070B180B230B330B3E0B500B2B
:10059000500B500B500B500B500B2706500BB1
:1005A0002F090906550B2906500BF902DB0A010C2D
:1005B0004309040C540B000C4309010C540B27078E
:1005C000500B0607E90A6807550B4F090F09CE04BF
:1005D000530B4F091909CE05020C540B2706500B7B
:1005E0002F090906550B2906500B000C4309030C73
:1005F000540B2707500B0607040B6807550B4F09D0
:100600000F09CE04000C540B4F090F09530B270799
:10061000500B0607130B6807550B4F091709EE041B
:10062000CE04050C540B4F091709EE05070C540BAB
:100630002706500B2F090906550B2906500B010CF4
:100640004309060C540B2707500B06072E0B6807AF
:10065000550B4F09060C0E098E04530B4F09010C64
:100660000E098E05530B2706500B2F090906550B53
:100670002906500B010C4309080C540B2707500B9B
:1006800006074B0B6807550B4F09060C0E098E0425
:10069000EE04CE04530B4F09010C0E09000C540B51
:0E06A0004F09010C0E09000C3E00A3045E0A77
:080800000D000E000A000D00BE
:021FFE00EA0FE8
:00000001FF
```

What is claimed is:

1. A system for testing the electrical integrity of an exit sign illuminated by a lamp, alternately powered by a battery rechargeable from a source of AC power and powered by the AC power source; comprising:

a. alarm means for indicating an electrical failure precluding illumination of the exit sign;

b. means for periodically testing for the presence of battery electrical power to illuminate the exit sign, said alarm means indicating the absence of battery power;

c. means for periodically testing for the provision of adequate battery power to illuminate the exit sign, said alarm means indicating inadequate battery power;

d. means for periodically testing for adequate recharging of the battery during a preselected period of time, said alarm means indicating the failure of the recharging of the battery; said means for periodically testing for the presence of the battery power, said means for periodically testing for the provision of adequate battery power, and said means for periodically testing for adequate recharging of the battery further comprise means for transferring the source of illumination of the exit sign between the AC source and the battery; and e. means for periodically testing for the existence of the lamp and for the operation of said means for transferring the source of illumination of the exit sign between AC source and the battery, including a detector for a ripple voltage associated with the AC source.

2. The system of claim 1 in which said alarm means comprises a visual unit having distinctive signals to selectively indicate the absence of battery power, inadequate battery power and failure of the recharging of the battery.

3. The system of claim 1 in which said detector comprises a control circuit, said control circuit includes a comparator for detecting the presence of said ripple voltage at the output of said comparator.

4. The system of claim 3 in which said alarm means comprises a visual unit having distinctive signals to selectively indicate the absence of battery power, inadequate battery power, and failure of the recharging of the battery.

5. The system of claim 4 in which said alarm means comprises a light emitting diode.

6. The system of claim 4 in which said alarm means further comprises a bicolor light emitting diode.

* * * * *